United States Patent [19]

Kojima et al.

[11] Patent Number: 4,604,783

[45] Date of Patent: Aug. 12, 1986

[54] METHOD OF AND APPARATUS FOR FORMING ELEMENT-FREE SPACES IN CONTINUOUS SLIDE FASTENER CHAIN WITH FLY STRIPS

[75] Inventors: Shinichi Kojima, Kurobe, Japan; Kiichiro Ishikawa, Marietta, Ga.

[73] Assignee: Yoshida Kogyo K. K., Tokyo, Japan

[21] Appl. No.: 679,033

[22] Filed: Dec. 6, 1984

[30] Foreign Application Priority Data

Dec. 9, 1983 [JP] Japan ..... 58-233225

[51] Int. Cl.[4] ..... B21D 53/52; A41H 37/06

[52] U.S. Cl. ..... 29/410; 29/766; 29/770

[58] Field of Search ..... 29/408–410, 29/766–770, 33.2

[56] References Cited

U.S. PATENT DOCUMENTS

| | | | |
|---|---|---|---|
| 2,836,239 | 5/1958 | Johns et al. | 29/770 |
| 3,570,104 | 3/1971 | Jensen | 29/766 |
| 4,443,924 | 4/1984 | Osaki | 29/408 |
| 4,457,062 | 7/1984 | Osaki | 29/408 |

*Primary Examiner*—Howard N. Goldberg
*Assistant Examiner*—Steven Nichols
*Attorney, Agent, or Firm*—Hill, Van Santen, Steadman & Simpson

[57] ABSTRACT

In a method of and apparatus for forming element-free spaces in a continuous slide fastener chain at ends of successive fly strips sewn to the slide fastener chain, the chain having a pair of intermeshed rows of coupling elements, portions of the intermeshed rows of coupling elements to be removed are detected by a sensor assembly disposed at a fixed position spaced a first distance upstream from a gap-forming device before such portions arrive at the gap-forming device. The sensor assembly first determines whether the longitudinal extent of a space provided between the confronting ends of an adjacent pair of the fly strips is larger than a predetermined distance, and then on the bases of the determination, controls the feeding of the chain and the operation of the gap-forming device so that the element-free spaces can be provided accurately at the ends of the respective fly strips regardless of the spacing between adjacent fly strips.

5 Claims, 4 Drawing Figures

METHOD OF AND APPARATUS FOR FORMING ELEMENT-FREE SPACES IN CONTINUOUS SLIDE FASTENER CHAIN WITH FLY STRIPS

BACKGROUND OF THE INVENTION

1. Field of the Invention:

The present invention relates to automation of the manufacture of trouser closures for fly openings, and more particularly to a method of and an apparatus for forming element-free spaces or gaps in a continuous slide fastener chain at its portions corresponding to ends of successive fly strips sewn to the chain.

2. Prior Art:

In the manufacture of trouser closures for fly openings, a continuous slide fastener chain, to which a succession of fly strips is sewn end to end in substantially abutting relation with only a very small space between an adjacent pair of the fly strips, is fed to an intermittently operating device for forming element-free spaces or gaps in the slide fastener chain. To this end, it has been customary practice to detect ends of the successive fly strips in order to automatically control the feeding of the chain as well as the intermittent operation of the gap-forming device. Such end detection is achieved by first folding the fly strips about a line of stitching to expose a pair of intermeshed rows of coupling elements of the chain as the latter advances, then providing temporarily a substantially V-shaped space between confronting ends of two adjacent fly strips prior to the arrival of the confronting ends at the gap-forming device, and finally sensing the presence of the V-shaped space when the trailing end of a preceding one of the adjacent two fly strips passes the light beam of a photoelectric sensor. However, such trailing end detection system is not suitable in applications wherein the fly strips are sewn to the slide fastener chain at random spaced fashion. More particualarly, when an adjacent pair of such fly strips is sewn to the chain with a relatively large space between confronting ends of the fly strips, an element-free space or gap formed in the chain would extend across only the trailing end of a preceding one of the two fly strips and terminate short of the leading end of the succeeding fly strip. With the slide fastener chain having the thus formed element-free space, automated operation in subsequent processing is difficult to achieve.

SUMMARY OF THE INVENTION

It is therefore an object of the present invention to provide a method of and an apparatus for forming element-free spaces in a continuous slide fastener chain at portions corresponding precisely to ends of successive fly strips stitched to the chain, regardless of the spaceing between adjacent fly strips.

Another object of the present invention is to provide a method capable of detecting portions of a slide fastener chain to be removed or gapped even when a relatively large space is defined between confronting ends of an adjacent pair of successive fly strips sewn to a slide fastener chain.

A further object of the present invention is to provide an apparatus comprising a sensor means for carrying out the above-mentioned detection.

According to the present invention, a continuous slide fastener chain with successive fly strips sewn thereto by at least one line of stitching is intermittently fed through a gap-forming device for forming element-free spaces in the chain, while the fly strips are being folded about the stitching to such an extent that interengaged rows of coupling elements of the chain are fully exposed. Portions of the rows of coupling elements to be removed are detected by a sensor assembly at a fixed position spaced a first distance upstream from the gap-forming device. Such detection is achieved by temporarily providing a relatively large space between confronting ends of an adjacent pair of the folded fly strips when the confronting ends arrive at the fixed point, sensing the departure of the trailing end of a preceding one of the two adjacent fly strips from the fixed point, regardless of whether the longitudinal extent of the provided space is larger than a predetermined distance, and thereafter sensing the arrival of the leading end of the succeeding fly strip at the fixed point only when the longitudinal extent of the provided space is larger than the predetermined distance. The feeding of the chain is stopped when the chain has advanced through the first distance after sensing of the trailing and leading ends, and substantially at the same time, the gap-forming device is operated to remove a portion of the rows of coupling elements, thereby providing an element-free space in the chain. The element-free spaces thus provided correspond accurately in position to opposite ends of the fly strips regardless of the spacing between adjacent fly strips.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
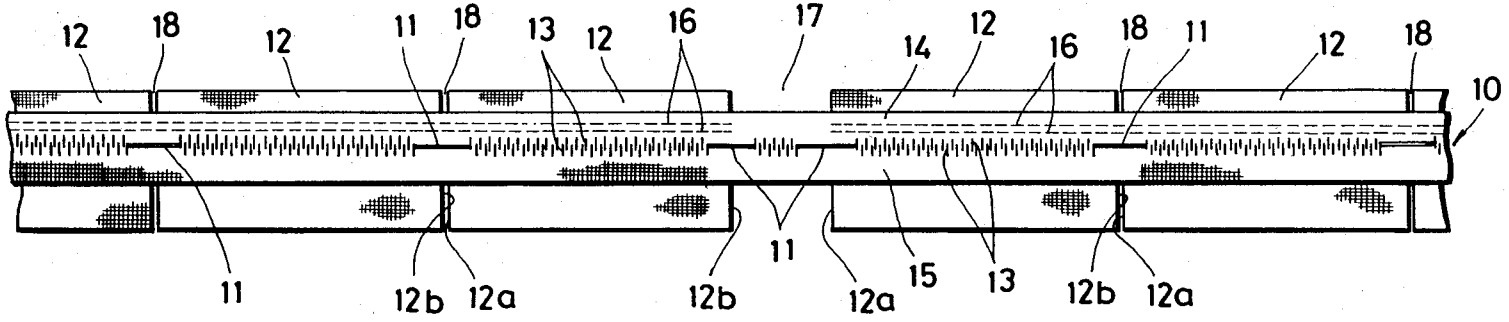
FIG. 1 is a schematic fragmentary plan view of a slide fastener chain with a sucession of fly strips sewn thereto, the chain having element-free spaces or gaps formed according to the present invention.

As shown in FIG. 1, a slide fastener chain 10 made according to the present invention includes a series of element-free spaces or gaps 11 provided at portions corresponding to opposite ends 12*a*, 12*b* of each of successive fly strips 12 attached to the slide fastener chain 10. Before being processed or gapped, the slide fastener chain 10 has a pair of continuous interengaged rows of coupling elements 13 supported on confronting longitudinal edges of a pair of stringer tapes 14, 15. The fly strips 12 are sewn to one of the stringer tapes 14 by a double line of stitching 16 running lengthwise of the fly strips 12 and the stringer tape 14. Each of the fly strips 12 is wider than the slide fastener chain 10 and has a length substantially equal to the length of individual slide fasteners (not shown) which are made from the chain 10 by severing the same at the element-free spaces 11. On being sewed to the chain 10, an adjacent pair of the fly strips 12, 12 shown in the center of FIG. 1 has been attached with a relatively large space 17 defined between their confronting ends 12*b*, 12*a*, while the remaining ones of the fly strips 12 have been attached end to end in substantially abutting relation with only a very small space 18 between their confronting ends 12*b*, 12*a*.

Figure 2:
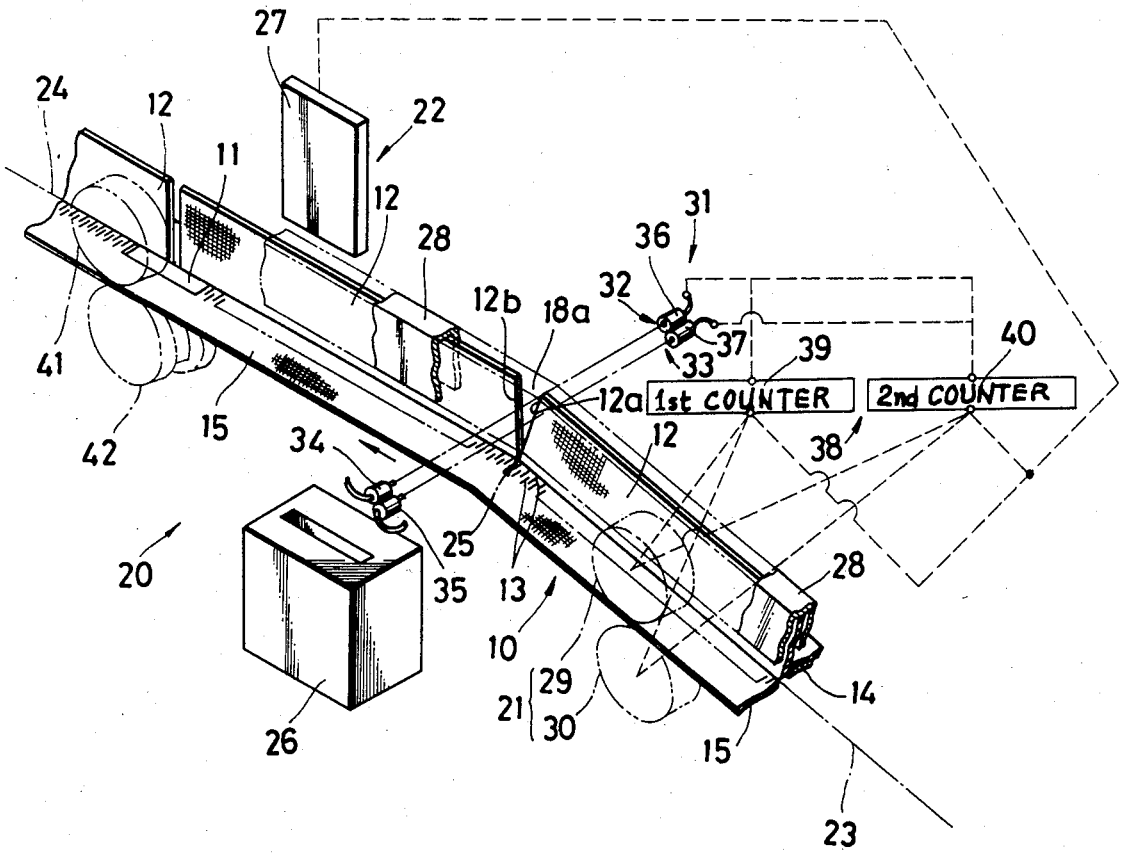
FIG. 2 is an enlarged fragmentary perspective view of an apparatus according to the present invention, with parts broken away, the view showing the manner in which confronting ends of two adjacent fly strips connected end to end are detected by a sensor assembly.

FIG. 2 show an apparatus 20 for forming the element-free spaces 11 in a continuous ungapped slide fastener chain 10 to which the fly strips 12 are already sewn. The apparatus 20 comprises a feed unit 21 for intermittently feeding the slide fastener chain 10 toward a gap-forming device 22 along a combined path including a pair of first and second straight paths 23, 24 joined at a fixed turning point 25. The gap-forming device 22 is disposed on the second straight path 24 and spaced at a distance L (FIGS. 3 and 4) downstream from the turning point 25. The device 22 is of conventional construction and includes a stationary die 26 and a cut-out punch 27 reciprocably movable toward and away from the die 26 for forming the element-free spaces 11 of the desired length.

The apparatus 20 also comprises a deflector 28 disposed on the combined path and extending along the first and second straight paths 23, 24 across the turning point 25 for folding the successive fly strips 12 about the stitching 16, as they pass the deflector 28, to such an extent that the unsewn side of the fly strips 12 lies at a right angle to the general plane of the stringer tapes 14, 15 to thereby expose the stringer tape 15 and the intermeshed rows of coupling elements 13. The feed unit 21 includes a pair of feed rollers 29, 30 engageable with opposite surfaces of the exposed stringer tape 15 and driven by a suitable drive source (not shown) to rotate in unison for feeding the chain 10 along the combined path both at a first speed and thereafter at a second speed lower than the first speed as portions of the interengaged rows of coupling elements 13 approach the gap-forming device 22.

The first and second straight paths 23, 24 are inclined with respect to one another so that the direction of movement of the successive fly strips 12 is shifted at the turning point 25 so as to provide temporarily a relatively large space between confronting ends 12*a*, 12*b* of an adjacent pair of the folded fly strips 12 when the confronting ends 12*a*, 12*b* arrive at the turning point 25.

A sensor assembly 31 is disposed adjacent to the turning point 25 for detecting portions of the rows of coupling elements 13 to be removed by the gap-forming device 22. The sensor assembly 31 includes a pair of first and second sensors 32, 33 of the photoelectric type. The first photoelectric sensor 32 spans the path of movement of the upstanding unsewn side of the folded fly strips 12 at the turning point 25. The second photoelectric sensor 33 spans the path of movement of the upstanding unsewn side of the folded fly strips 12 at a point which is spaced a predetermined distance D (FIGS. 3 and 4) upstream from the turning point 25. Each of the photoelectric sensors 32, 33 includes a light projector 34, 35 and a photoelectric cell 36, 37 disposed in alignment with the light projector 34, 35 across the path of movement of the upstanding unsewn side of the folded fly strips 12.

The photoelectric cell 36 of the first sensor 32 produces a first signal pulse each time the trailing end 12*b* of a one of the fly strips 12 passes the sensor 32 to allow the light beam to reach the photoelectric cell 36. The cell 36 also produces a second signal pulse each time the leading end 12*a* of the next succeeding fly strip 12 arrives at the sensor 32 to block the light beam. The photoelectric cell 37 of the second sensor 33 produces only a first signal pulse each time the trailing end 12*b* of said one fly strip 12 passes the sensor 33. The first signal pulse and the second signal pulse produced by the first sensor 32 indicate respectively the departure of the trailing end 12*b* from the turning point 25, and the arrival of the leading end 12*a* at the turning point 25. The second sensor 33 is positionally adjustable so as to vary the distance D (FIGS. 3 and 4) depending on the length of the element-free space 11 formed by the punch 27.

The apparatus 20 further includes a stopper 38 controlled by the sensor assembly 31 and operatively connected to the feed unit 21 and the gap-forming device 22 for controlling their operations in accordance with instructions from the sensor assembly 31. The stopper 38 includes a pair of first and second counters 39, 40 operatively connected to each of the feed rollers 29, 30 for counting the number of revolutions of the feed rollers 29, 30 to thereby measure the amount of forward movement of the chain 10 by the rollers 29, 30.

The first counter 39 is also connected in circuit with the photoelectric cell 36 of the first sensor 32 and, upon receipt of a first signal pulse from the sensor 32, it starts to count the number of revolutions of the rollers 29, 30 until the number of counted revolutions becomes equal to a predetermined figure present or registered in the counter 39. The predetermined figure means that the chain 10 has advanced by the distance L (FIGS. 3 and 4) after the sensing of the trailing end 12*b* of each fly strip 12. When the predetermined figure is reached, the counter 39 issues an output signal pulse to the feed unit 21 for interrupting its operation. This output signal pulse is also given to the gap-forming device 22 for initiating the operation of the punch 27.

The second counter 40 is connected in parallel to the photoelectric cells 36, 37 of the sensors 32, 33. The counter 40 has the same structure and function as the first counter 39 with the exception that it is activated only when a second signal indicative of the arrival of the leading end 12*a* is received from the first sensor 32, subsequent to the concurrent receipt of first signal pulses from the first and second sensors 32, 33. The predetermined figure registered in the counter 40 means that the leading end 12*a* of the fly strip 12 has advanced by the distance L after having been sensed by the first sensor 32. Each of the first and second counters 39, 40 also produces a signal pulse at a suitable time before the predetermined figure is reached. This signal pulse is given to the feed unit 21 to switch the speed of feeding from the first speed to the second speed lower than the first speed.

A pair of feed-out rollers 41, 42 is disposed on the second path 24 downstream of the gap-forming unit 22 for discharging the gapped slide fastener chain 10 from the apparatus 20. The rollers 41, 42 are driven to rotate in synchronism with the feed rollers 29, 30.

Figure 3:
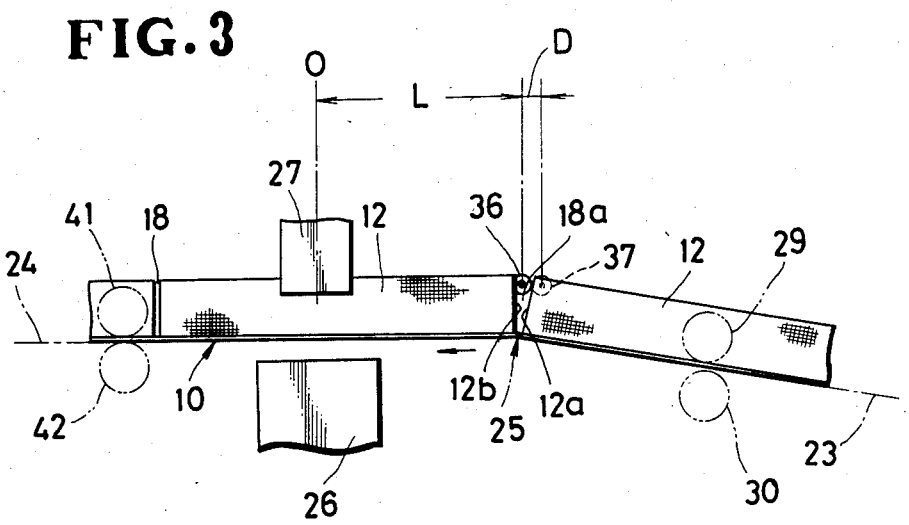
FIG. 3 is a schematic fragmentary side elevational view corresponding to FIG. 2.

Operation of the apparatus 20 thus constructed is as follows: The slide fastener chain 10 is fed in the direction of the arrow shown in FIG. 2 along the combined path by means of the feed rollers 29, 30, with the successive fly strips 12 folded by the deflector 28 about the stitching 16 (FIG. 1) to such an extent that the unsewn side of the fly strips 12 lies at a right angle to the general plane of the stringer tapes 14, 15. Since the first and second straight paths 23, 24 of the combined path are inclined with respect to one another for shifting the direction of movement of the fly strips 12, a relatively large space is temporarily provided between the confronting ends 12*b*, 12*a* of an adjacent pair of the fly strips 12 when the same confronting ends 12*b*, 12*a* arrive at the turning point 25. More specifically, when the two adjacent fly strips 12 define between their confronting ends 12*b*, 12*a* a very narrow space 18 (FIG. 1), upon arrival of the confronting ends 12*b*, 12*a* at the turning point 25, the space 18 is temporarily enlarged into a substantially V-shape as shown in FIGS. 2 and 3 at 18*a*. Likewise, a relatively wide space 17 (FIG. 1) defined between the confronting ends 12*b*, 12*a* is temporarily further enlarged as at 17*a* shown in FIG. 4. The temporarily enlarged space 17*a*, 18*a* allows passage of the light beam from the light projector 34 as soon as the trailing end 12*b* of a preceding one of the two adjacent fly strips 12 passes over the turning point 25, thereby activating the photoelectric cell 36 so as to produce a first signal pulse indicative of the departure of the same trailing end 12*b* from the turning point 25.

With such a condition shown in FIGS. 2 and 3, the V-shaped space 18*a* allows only passage of the light beam from the light projector 34, thereby activating the photoelectric cell 36. The light beam from the projector 35 is blocked by the upstanding unsewn side of the next succeeding fly strip 12. Upon receipt of a first signal pulse from the photoelectric cell 36, the first counter 39 starts to count the number of revolutions of the rollers 29, 30 until the number of counted revolutions corresponds to a predetermined figure registered in the counter 39. When the predetermined figure is reached, the counter 39 issues an output signal pulse to the feed unit 21 so as to interrupt its operation. At that time, the trailing end 12*b* of the preceding fly strip 12 has advanced from the position of FIG. 3 by the distance L, i.e. the trailing end 12*b* is located beneath the center O of the punch 27. Substantially at the same time, the output signal pulse of the counter 39 is also given to the gap-forming device 22 to initiate the operation of the punch 27 for removing a portion of the intermeshed rows of coupling elements 13, thereby providing an element-free space 11 in the chain. The element-free space 11 thus formed extends transversely across the confronting ends 12*b*, 12*a* of the two adjacent fly strips 12.

Figure 4:
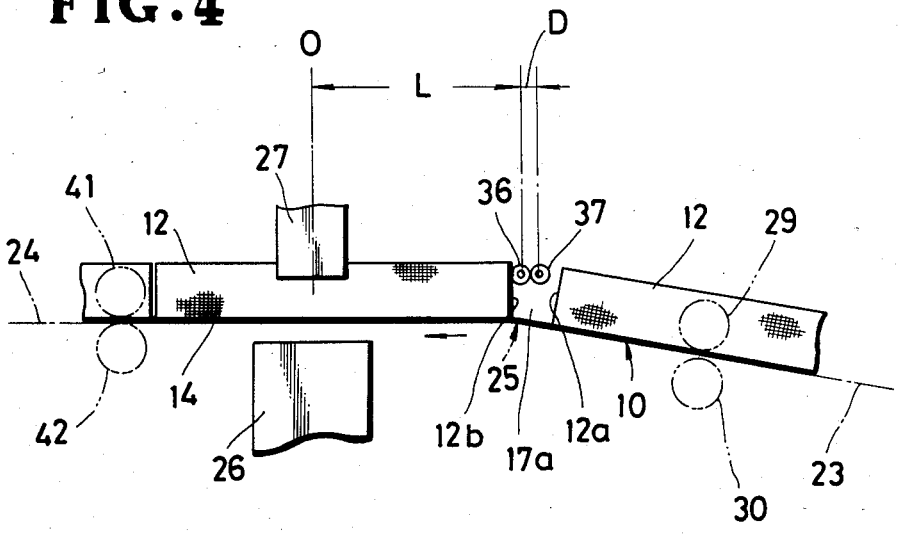
FIG. 4 is a view similar to FIG. 3, but showing the manner in which confronting ends of two adjacent fly strips spaced at a relatively long distance are detected by the sensor assembly.

Another detecting condition is shown in FIG. 4 in which a wide space 17*a* is provided between the confronting ends 12*b*, 12*a* of two adjacent fly strips 12 when the same confronting ends 12*b*, 12*a* arrive at the turning point 25, the longitudinal extent of the space 17*a* being much larger than the distance D between the photoelectric cells 36, 37. As soon as the trailing end 12*b* of a preceding one of the two fly strips 12 passes over the turning point 25, the light beams from both the projectors 34, 35 are allowed to reach the corresponding photoelectric cells 36, 37 whereupon a pair of first signal pulses is issued from the cells 36, 37, respectively, to the first and second counters 39, 40. Upon receipt of one of the first signal pulses, the first counter 39 is activated and thereafter successive steps of operation are achieved in the same manner as described above with respect to the formation of the element free space 11 at the confronting ends 12*b*, 12*a* defining therebetween the very small space 18. The obtained element-free space 11 (FIG. 1) extends transversely across the trailing end 12*b* of the preceding fly strip 12 but it terminates short of the leading end 12*a* of the succeeding fly strip 12.

With continued movement of the chain 10, the leading end 12*a* of the succeeding fly strip 12 closes the photoelectric cell 36 whereupon the cell 36 issues a second signal pulse to the second counter 40 to activate the latter. When the leading end 12*a* of the succeeding fly strip 12 has been advanced through the distance L from the position of FIG. 4, the second counter 40 produces an output signal pulse by means of which the feeding of the chain 10 is interrupted and the operation of the punch 27 is initiated. The resultant element-free space 11 extends transversely across the leading end 12*a* of the succeeding fly strip 12. The speed of feeding of the chain 10 is changed from the high speed to the low speed before the sensed trailing and leading ends 12*b*, 12*a* arrive at the gap-forming device 22 in response to the signal pulse issued from the respective counters 39, 40 to the feed unit 21.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of forming element-free spaces in a continuous slide fastener chain at ends of successive fly strips sewn by at least one line of stitching to the slide fastener chain, the chain having a pair of interengaged rows of coupling elements, said method comprising the steps of:

(a) feeding a continuous ungapped slide fastener chain longitudinally through a gap-forming station, with the fly strips folded about the stitching, to such an extent that the interengaged rows of coupling elements are fully exposed;

(b) detecting portions of the interengaged rows of coupling elements to be removed at said gap-forming station by (1) temporarily providing a relatively large space between confronting ends of adjacent pair of the folded fly strips when the confronting ends arrive at a fixed turning point spaced a first distance upstream from said gap-forming station, (2) sensing the departure of the trailing end of a preceding one of the adjacent pair of fly strips from said turning point, and (3) then sensing the arrival of the leading end of the succeeding fly strip at a second point spaced a second distance upstream of said fixed turning point so that the last-mentioned sensing takes place only when the longitudinal extent of said temporary space is larger than said second distance;

(c) temporarily stopping the feeding of the chain when the chain has advanced through said first distance after said sensing of the trailing and leading ends; and (d) removing the thus detected portions of the interengaged rows of coupling elements at said gap-forming station while the chain is at rest.

2. A method according to claim 1, said second point being positionally adjustable along the path to vary said second distance depending on the length of an element-free space to be formed.

3. A method according to claim 1, said feeding including moving the chain along the path at a first speed and then at a second speed lower than said first speed as said detected portions of the interengaged rows of coupling elements approach said gap-forming station.

4. An apparatus for forming gaps of element-free spaces in a continuous slide fastener chain at ends of successive fly strips sewn by at least one line of stitching to the slide fastener chain, the chain having a pair of interengaged rows of coupling elements, said apparatus comprising:

(a) a power-driven feed unit for feeding the continuous ungapped slide fastener chain, with the successive fly strips sewn thereto, along a combined path including a pair of first and second straight paths joined at a fixed turning point;

(b) a deflector disposed on said combined path for folding the fly strips, as they pass said deflector, to such an extent that the interengaged rows of coupling elements are fully exposed;

(c) said first and second straight paths being inclined with respect to one another for shifting the direction of movement of the fly strips at said turning point so as to temporarily provide a relatively large space between confronting ends of an adjacent pair of folded fly strips;

(d) a sensor assembly disposed adjacent to said turning point and including a first sensor spanning the path of movement of the folded fly strips at said turning point for sensing the departure of the trailing end of a preceding one of the adjacent pair of the fly strips from said turning point, and a second sensor spanning the path of movement of the folded fly strips at a point spaced a predetermined distance upstream from said turning point for sensing the arrival of the leading end of the succeeding fly strip only when the longitudinal extend of said temporary space is larger than said predetermined distance;

(e) a stopper operatively connected to said sensor assembly and said feed unit for temporarily stopping the feeding of the fastener chain when the chain has advanced through a distance after the sensing of the trailing and leading ends; and (f) a power-driven gapping device disposed on one of said first and second paths at a position spaced the last-named distance downstream from said fixed turning point and operatively controlled by said stopper for removing portions of the interengaged rows of coupling elements while the chain is at rest.

5. An apparatus according to claim 4, said first sensor being operable to produce a first signal pulse each time the trailing end is sensed by said first sensor, and also a second signal pulse each time the leading end is sensed by said first sensor, said second sensor being operable to produce a third signal pulse each time the trailing end is sensed by said second sensor, said stopper comprising a first counter operatively connected to said first sensor and activated by said first signal pulse, and a second counter operatively connected to both said first and second sensors and activated only when it receives said second pulse subsequent to the receipt of both said first and third signal pulses.

* * * * *